US007692396B2

(12) United States Patent
Ctvrtnicek

(10) Patent No.: US 7,692,396 B2
(45) Date of Patent: Apr. 6, 2010

(54) ELECTROMOTIVE FURNITURE DRIVE

(75) Inventor: Martin Ctvrtnicek, Bünde (DE)

(73) Assignee: Dewert Antriebs-und Systemtechnik GmbH, Kirchlengern (DE)

( * ) Notice: Subject to any disclaimer, the term of this patent is extended or adjusted under 35 U.S.C. 154(b) by 216 days.

(21) Appl. No.: 11/767,003

(22) Filed: Jun. 22, 2007

(65) Prior Publication Data

US 2008/0012516 A1 Jan. 17, 2008

(30) Foreign Application Priority Data

Jun. 28, 2006 (DE) ..... 20 2006 010 135 U

(51) Int. Cl.
*G01R 31/02* (2006.01)

(52) U.S. Cl. ..... 318/490; 318/466; 318/554; 318/671

(58) Field of Classification Search ..... 318/490, 318/466, 468, 552–554, 85, 635, 671–673; 5/616, 617

See application file for complete search history.

(56) References Cited

U.S. PATENT DOCUMENTS

| | | | | |
|---|---|---|---|---|
| 6,492,786 | B1 * | 12/2002 | Vang et al. | 318/553 |
| 6,794,841 | B1 * | 9/2004 | Vang et al. | 318/553 |
| 7,091,692 | B2 * | 8/2006 | Ctvrtnicek et al. | 318/806 |
| 7,511,442 | B2 * | 3/2009 | Jehle et al. | 318/466 |
| 2002/0030457 | A1 * | 3/2002 | Bastholm et al. | 318/434 |
| 2003/0052626 | A1 * | 3/2003 | Wehmeyer et al. | 318/85 |

* cited by examiner

*Primary Examiner*—Bentsu Ro
*Assistant Examiner*—Thai Dinh
(74) *Attorney, Agent, or Firm*—Barnes & Thornburg LLP

(57) ABSTRACT

An electromotive furniture drive for adjusting at least one movable component of a piece of furniture, has at least one electric motor for adjusting the movable component, at least one operating device with switching elements for actuating the electric motor, at least one control unit for controlling the at least one electric motor as a function of the operating device, and at least one power supply unit. At least one analyzing device has at least one actuating element for checking the function of the at least one electric motor, the at least one control unit, the at least one operating device and of the at least one power supply unit, and has at least one signaling element.

12 Claims, 2 Drawing Sheets

ELECTROMOTIVE FURNITURE DRIVE

CROSS-REFERENCE TO RELATED APPLICATIONS

The present application claims the benefit of priority to German Patent Application No. 20 2006 010 135.7 filed 28 Jun. 2006, the contents of which are incorporated herein by reference in their entirety.

BACKGROUND AND SUMMARY OF THE DISCLOSURE

The invention relates to an electromotive furniture drive for adjusting at least one movable component of a piece of furniture.

As a rule, such electromotive furniture drives require no maintenance. However, they are subjected to a certain amount of wear during their use. In individual cases, particularly after an extended use, this wear can cause an impairment of functions if a component, for example, the manual operating device, no longer or only to a limited extent has or carries out a desired function as a result of excessively frequent use. Under certain circumstances, such an impairment of functions may involve the function of the entire electromotive furniture drive because the user cannot easily recognize in such a case which one of the components has a defect. A complete system will therefore be exchanged although only one component would have had to be exchanged. This is a disadvantage resulting in corresponding costs with respect to shipment and checking.

One known solution is that electromotive furniture drives, particularly for seating furniture, have been equipped with a visual indicating system, which visually signals the action of voltage upon the respective motor. By means of this device, the user can recognize, for example, by the lighting-up of an indicator light in his operating device, whether a signal is emitted during the operation. By means of light sources of another light in the motor line, the user can recognize, in this case, whether this motor line is also supplied with voltage during the operation. This permits a detection of a defective component in a certain manner.

This construction has been successful. However, a clear limitation for the monitoring of the individual components of the electromotive furniture drive is disadvantageous because, by means of this above-mentioned construction, only the function of the respective electric motor can be checked if the operating device is functioning. In the case of a defective operating device, further investigations with respect to defective components are impossible.

The present system creates an electromotive furniture drive having an analyzing device which no longer has the above-mentioned disadvantages and the corresponding analyzing device.

The present system creates an electromotive furniture drive with an analyzing device which has an actuating element.

In this manner, a user is capable of immediately determining, by the simple actuation of the analyzing device, which one of the components has a defect. This becomes possible irrespective of which components are defective.

In at least one embodiment, the analyzing device is connected down stream of the power supply unit. Since the involved motors are so-called low-voltage motors, the power supply unit may consist of at least of a transformer, which reduces the public electric supply system voltage to a voltage with a lower potential.

However, the power supply unit may also have an accumulator, a switched-mode power supply, a voltage transducer or a system-side power supply. In the latter case, the motors may be constructed as system-supplied motors. Furthermore, an input-side system clearing device, an output-side rectifier circuit for generating a direct current and/or an output-side control device having electromechanical switches may be assigned to the power supply unit. In this case, a control device has control paths coming from the manual operation and leading to the respective electric motor.

In at least one embodiment, at least one actuating element has the same function as at least one switching element included in the operating device included in the electromotive furniture drive. As a result, checking of the functionality of components of the drive advantageously becomes possible independently of defective components. In this case, an actuating element can be assigned to each switching element of the operating device. Alternatively, it is also conceivable that several switching elements may be assigned to the actuating element. When the actuating element is operated, a circuit is closed. This may, for example, provide at least one control path. Thus, the operation of the respective actuating element is equivalent to the operation of the switching element(s) of the operating device. Furthermore, a display, such as a visual display, may also be assigned to the power path, which display emits a light signal as soon as the power path is supplied with voltage. Thus, by operating the actuating element, the operator can check the functionality of one or more motors, the correct functioning of the power supply unit, of the control unit or of the branching unit and of the operating device independently of a possibly faulty component.

In this case, in which the control unit has power switching elements for switching a power path of the at least one electric motor, it is provided in an embodiment that the at least one actuating element is switched parallel to at least one switching element of the operating device. As a result, the function of the power switching elements of the control unit and of motors connected thereto can be easily checked without operation of the operating device. For checking the functionality of the operating device itself, the operating device is operated testing of the functionality of the other components, whereby, with the preceding positive checking of the corresponding components, it can easily be determined whether the defect is in the operating device.

At least one embodiment provides a control unit having a branching device, in which the analyzing device is integrated. In this case, the power switching elements are arranged in the operating device. This provides direct switching of the power path of the electric motor because the switches are then arranged in the power path. In this case, in which the at least one switching element of the operating device has a power switching element for switching the power path of the at least one electric motor, the control unit is constructed as a branching unit. In this alternative embodiment, the at least one actuating element in the analyzing device has a power switching element for interrupting the power path to the operating device and a power switching element for switching the power path to the at least one electric motor. This results in an expansion of the range of use of the analyzing device.

In at least one embodiment, the at least one analyzing device is a component of the at least one control unit. As a result, it is permitted that an electromotive furniture drive is equipped with an integrated analyzing device, which enables simple checking. Individual components, such as the transformer, the accumulator, the switched-mode power supply, the voltage transducer, the rectifier circuit, the analyzing device and the control device may be inserted in a common housing. Individual components or a selection of respective components may also be inserted in a common housing. In this case, the housing may be partially or completely filled, so that an insulating material can be cast around the components.

In at least one alternative embodiment, the at least one analyzing device is constructed to be mountable on the at least one control unit. In this manner, the analyzing device can be retrofitted. A temporary installation of the analyzing device is thereby also conceivable.

In at least one embodiment, at least one analyzing device has an evaluation unit, which permits a comfortable checking with a correspondingly simple display; automated checking is also conceivable.

In at least one embodiment, the analyzing device is electrically connected down stream of the power supply unit. This also advantageously permits the functional testing of this power supply unit. In this case, the analyzing device has its own power supply, for example, a battery, whereby it functions advantageously independent of the power supply unit.

An analyzing device having at least one actuating element for testing the function of an electromotive furniture drive and at least one its components are constructed such that the analyzing device has at least one signaling element. In this case, the at least one actuating element has the same functionality of at least one switching element of the operating device of the electromotive drive, thereby allowing functionality testing which is close to reality.

In at least one embodiment, the analyzing device can be built onto the electromotive drive or can be installed in the electromotive drive. This results in a broad usage range of the analyzing device.

The device will be explained by the following description of preferred embodiments with reference to the attached drawings.

DETAILED DESCRIPTION OF THE EMBODIMENTS

Figure 1:
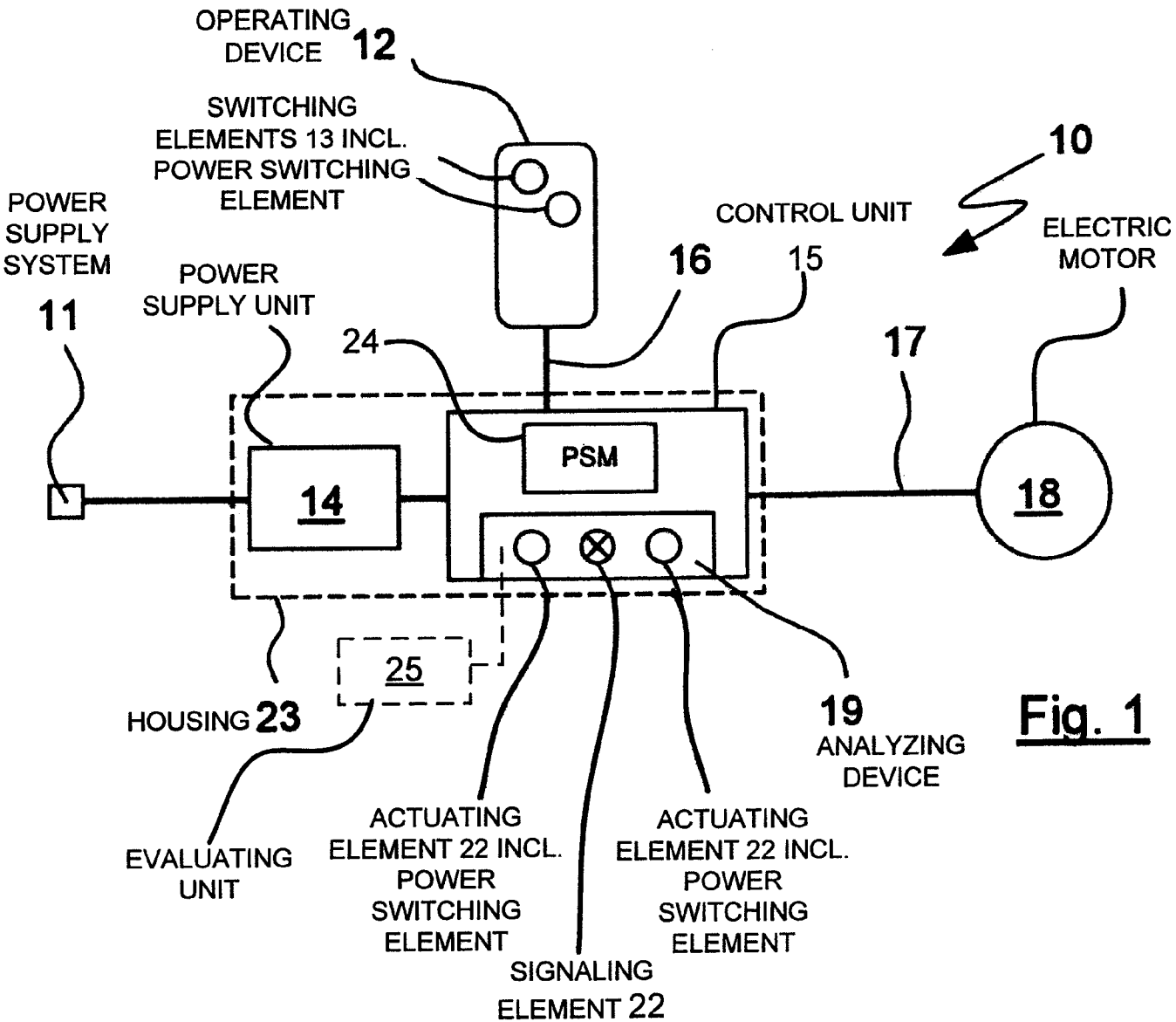
FIG. 1 is a schematic view of a first embodiment of an electromotive furniture drive with a control path and a power path.

The electromotive furniture drive 10 schematically illustrated in the first embodiment consists of several components: an operating device 12 having several switching elements 13, for example, key buttons; an electric motor 18; a power supply unit 14 and a control unit 15. The power supply 14 is configured to be connected to a public power supply system 11, which may be formed by a plug part having an inserted system clearing device. The power supply unit 14 consists of at least a transformer, which can be followed by a rectifier circuit and a filtering device. The switching signals, which can be triggered by the respective switching elements 13 of the operating device 12, are fed by way of a control path 16 through a line to the control unit 15. In a manner not shown in detail, electromechanical switches, such as relays, are arranged in the control unit 15; the switches admit a voltage to the power path 17 as soon as a switching element 13 is operated. A series of switching elements 13 are assigned to each electric motor 18 in order to generate signals for both rotating directions of the electric motor 18.

Furthermore, the electromotive furniture drive 10 has an analyzing device 19, which in this example has two actuating elements 21 and one signaling element 22. Here, the analyzing device 19 is arranged inside the control unit 15. Naturally, the analyzing device 19 may also be mounted outside the control unit 15 by means of corresponding contacts and connections or can be removably mounted, for example, by way of a suitable plug-type connection.

According to FIG. 1, the power supply unit 14 and the control unit 15 and, as required, also the analyzing device 19 may be inserted in a common housing 23.

The analyzing device 19 essentially consists of the actuating elements 21 and of a visual display, the signaling element 22, which consists at least of a light having at least one indicating color. In a manner not shown in detail, the actuating elements 21 are connected with electrical power switching modules 24 which, in this first embodiment, are switched parallel to the switching elements 13, while the signaling element 22 is switched parallel to the power path 17.

Each actuating element 21 is operated for checking functions. The signaling element 22 will then light up because the supply voltage for the electric motor 18 is applied to the output of the control unit 15 to a contact, which is not shown. The function of the control unit 15 can thereby be checked. Simultaneously, the connected electric motor 18 has to start unless it is in an end position at the time. In this case, the opposite running direction of the electric motor 18 has to be selected by way of the corresponding actuating element 21 or switching element 13.

After the positive function testing of the electric motor 18, the function of the operating device 12 can be checked, in that the latter is operated, in which case identical functions of the electric motor 18 or of the signaling element 22 have to be triggered.

In the control unit 15, the analyzing device 19 is arranged electrically down stream of the power supply unit 14. If the power supply unit 14 is defective, the analyzing device 19 cannot be actuated, whereby the power supply unit 14 can easily be checked. The analyzing device 19 can also additionally be equipped with its own power supply, such as a battery, whereby, also in the case of a defective power supply unit 14, additional function tests can be carried out. This is particularly advantageous because a defective power supply unit 14 could, under certain circumstances, have triggered another effect, for example, in the operating device 12.

Figure 2:
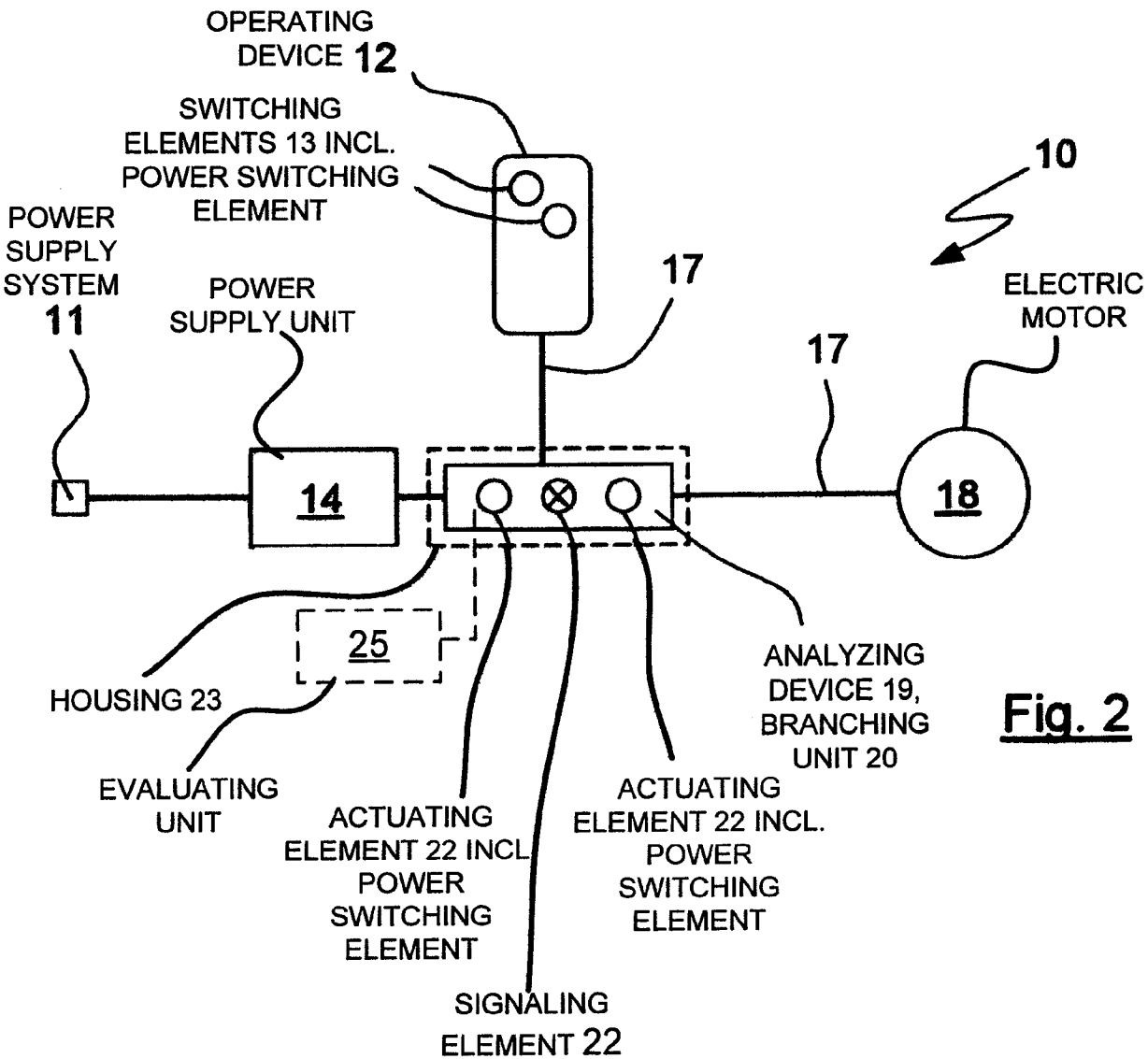
FIG. 2 is a schematic view of a second embodiment of an electromotive furniture drive with a power path.

FIG. 2 shows a second embodiment of the electromotive furniture drive 10, which is essentially identical with the embodiment of FIG. 1; however, in this embodiment, the control unit 15 has no power switching elements but only a branching device 20 so that the control path 16 does not exist. In a manner not shown in detail, the switching elements 13 directly switch the power path 17 of the electric motor so that the switching elements 13 are integrated in the circuit of the power path 17. According to the second embodiment according to FIG. 2, the operating device 12, the power supply unit 14 and the respective electric motor 18 are electrically connected with one another by means of the branching unit 20. In this case, for example, the analyzing device 19 may be inserted in a housing 23 of the branching unit 20 or housing parts 23 can be at least partially sprayed around it.

In a manner not shown in detail, the actuating elements 21 and the signaling element 22 are also integrated in the circuit of the power path 17. In this case, the actuating element 21 has a power switching element for interrupting the power path 17 to the operating device 12 and a power switching element for switching the power path 17 to the electric motor 18 because the wiring of the switching elements 13, which is not explained in detail above, is in series and does not permit parallel switching with actuating element 21.

According to FIGS. 1 and 2, all lines or paths are constructed as multi-conductor cables and may have a plug-type contact on at least one end.

The electric motors 18 are indicated symbolically and, in addition to an electric motor 18, may also have mechanical transmissions, for example, in the form of a gearing, a worm gearing, a threaded spindle gearing or combinations thereof.

In a manner not shown in detail, the housing 23 has openings through which the respective actuating element 21 can be operated, and the respective signaling element 22 can be inspected. For this purpose, the actuators of the respective actuating elements 21 can end with the surface of the housing 23 or can be arranged to be set back toward interior.

The invention is not limited to the explained embodiments but can be modified in multiple manners.

Thus, for example, the analyzing device 19 may have an optional evaluating unit 25 (as illustrated in FIGS. 1 and 2, wherein the optional nature of the evaluating unit 25 is indicated by dashed lines); this evaluating unit 25 can permit an automatic checking and indicating of the functionality of the individual components of the electromotive furniture drive, as explained above.

The analyzing device 19 may also have electronic components, such as semiconductor switches, and additional power switching elements, such as relays, for checking the function of components.

I claim:

1. An electromotive furniture drive for adjusting at least one movable component of a piece of furniture, the drive comprising;

at least one electric motor configured to adjust the movable component, at least one operating device with switching elements configured to actuate the at least one electric motor, at least one control unit for controlling the at least one electric motor as a function of the at least one operating device, at least one power supply unit for the electric supply of the control unit, at least one analyzing device including at least one actuating element and at least one signaling element, the at least one actuating element being configured to check functionality of each of the at least one electric motor, the at least one control unit, the at least one operating device and the at least one power supply unit.

2. The electromotive furniture drive of claim 1, wherein the at least one actuating element of the at least one analyzing device is configured to perform the same function as the at least one switching element of the at least one operating device.

3. The electromotive furniture drive of claim 2, wherein the at least one control unit includes a plurality of power switching elements configured to switch a power path of the at least one electric motor, and wherein the at least one actuating element of the at least one analyzing device is switched parallel to the switching of the at least one switching element of the operating device by the power switching elements of the at least one control unit.

4. The electromotive furniture drive of claim 2, wherein:

the at least one switching element of the at least one operating device includes a power switching element configured to switch a power path of the at least one electric motor, the at least one control unit is configured as a branching unit, and the at least one actuating element of the at least one analyzing device includes:

a power switching element configured to interrupt a power path to the at least one operating device, and a power switching element configured to switch the power path to the at least one electric motor.

5. The electromotive furniture drive of claim 1, wherein the at least one analyzing device is a component of the at least one control unit.

6. The electromotive furniture drive of claim 1, wherein the at least one analyzing device is constructed to be mountable on the at least one control unit.

7. The electromotive furniture drive of claim 1, wherein the at least one analyzing device (has includes an evaluating unit.

8. The electromotive furniture drive of claim 1, wherein the at least one analyzing device is electrically connected downstream of the at least one power supply unit.

9. The electromotive furniture drive of claim 1, wherein the at least one analyzing device has its own power supply.

10. An analyzing device comprising:

at least one actuating element configured to perform functionality testing of each of at least one electric motor, at least one control unit, at least one operating device and at least one power supply unit included in an electromotive furniture drive; and at least one signaling element.

11. The analyzing device of claim 10, wherein the at least one actuating element is configured to perform the same function as the at least one switching element.

12. The analyzing device of claim 10, wherein the analyzing device is constructed to be one of built onto and installed in the electromotive furniture drive.

* * * * *